United States Patent [19]

Smith et al.

[11] Patent Number: 4,734,073

[45] Date of Patent: Mar. 29, 1988

[54] METHOD OF MAKING A THERMIONIC FIELD EMITTER CATHODE

[75] Inventors: Bernard Smith, Ocean; Louis E. Branovich, Howell Township, Monmouth County, both of N.J.

[73] Assignee: The United States of America as represented by the Secretary of the Army, Washington, D.C.

[21] Appl. No.: 919,959

[22] Filed: Oct. 10, 1986

[51] Int. Cl.[4] ..... H01J 29/04; H01J 9/04

[52] U.S. Cl. ..... 445/50; 313/346 DC; 313/351

[58] Field of Search ..... 445/50, 49, 51, 36; 313/346 DC, 346 R, 351

[56] References Cited

U.S. PATENT DOCUMENTS

| | | | |
|---|---|---|---|
| 2,721,372 | 10/1955 | Levi | 445/50 |
| 2,986,799 | 6/1961 | Levi et al. | 445/50 |
| 3,303,559 | 2/1967 | Holtzclaw | 445/49 X |
| 3,376,461 | 4/1968 | Millward | 313/351 X |
| 3,594,885 | 6/1969 | Miram | 445/50 X |
| 4,165,473 | 8/1979 | Falce | 313/346 DC X |
| 4,300,149 | 11/1981 | Howard et al. | 357/71 |
| 4,478,590 | 10/1984 | Rychlewski | 313/346 R X |
| 4,671,777 | 6/1987 | Van Esdonk et al. | 313/346 DC X |
| 4,675,570 | 6/1987 | Green | 313/346 DC X |

FOREIGN PATENT DOCUMENTS 0072273 2/1983 European Pat. Off. .

*Primary Examiner*—Kenneth J. Ramsey

*Attorney, Agent, or Firm*—Sheldon Kanars; Jeremiah G. Murray; Roy E. Gordon

[57] ABSTRACT

The face of a cathode surface is machined to provide a spiral surface finish with microscopic sharp symmetrical protrusions. The cathode gives enhanced emission due to field emission generated at the sharp symmetrical protrusions and due to the increased surface area.

6 Claims, 4 Drawing Figures

METHOD OF MAKING A THERMIONIC FIELD EMITTER CATHODE

The invention described herein may be manufactured, used, and licensed by or for the Government for governmental purposes without the payment to us of any royalty theron.

This invention relates in general to a method of making a thermionic field emitter cathode and in particular to a method of making a very high current density cathode for microwave/millimeter wave (mw/mmw) tubes.

BACKGROUND OF THE INVENTION

Microwave devices for high power (mw/mmw) tubes are required to generate RF power outputs in the range of tens of Kilowatts to hundreds of Kilowatts as a function of frequency. These devices require cathodes capable of operating at current densities up to 12 $A/cm^2$ in gridded devices. Present day state of the art cathodes operating at these current densities have a fairly short life. In high power (mw/mmw) tubes, in many cases, the life limiting component is the electron source.

The present state of the art for cathodes operating at current densities of 8 $A/cm^2$ is to fabricate the matrix, and then impregnate the matrix with an impregnant that is some molar ratio of BaO, CaO and $Al_2O_3$. Once the cathode is impregnated, the cathode is then given an overcoat of some platinum group metal. These cathodes give good life at current densities up to 8 $A/cm^2$ operating in a pulse mode. Operating CW at 8 $A/cm^2$, the relative life of these cathodes declines significantly. In addition to a deterioration in operating life when operated CW, the life of these cathodes can be adversely affected by back bombardment.

SUMMARY OF THE INVENTION

The general object of this invention is to provide a method of making a thermionic cathode. A more particular object of the invention is to provide a method of making a very high current density cathode for (mw/mmw) tubes. A still further object of the invention is to provide a method of making a cathode capable of delivering tens of amperes of current CW at current densities of 20 $A/cm^2$ for lifes in excess of 5000 hours. Another object of the invention is to provide a method of making a cathode that has a much better life operating CW and is not adversely affected by back bombardment. Another object of the invention is to provide a method of making a cathode that has a virtual emission area that is double the calculated emission area for a given diameter cathode.

It has now been found that the aforementioned objects can be obtained by a method of making a cathode including machining the face of the cathode surface to provide a spiral surface finish with microscopic sharp symmetrical protrusions or spikes. Instead of a smooth surface, the method of this invention provides a cathode surface having sharp symmetrical protrusions across the cathode surface which effectively doubles the active surface area. Cathodes made by the method of this invention give enhanced emission due to field emission generated at the sharp symmetrical protrusions and also due to the increased surface area. In fact, current densities in excess of 100 $A/cm^2$ can be obtained by cathodes made according to the method of the invention. Such current densities are required for super powered microwave devices.

More particularly, according to this invention, a method of making a thermionic field emitter cathode for use in (mw/mmw) high power electron tubes from tungsten and iridium powders is provided, the method including the steps of:

(A) mixing the tungsten and iridium powders in the ratio of 80 parts by weight tungsten powder to 20 parts by weight iridium powder, (B) isostatically pressing and compressing the powders to a porosity of about 50 percent, (C) sintering the resulting rod shaped cathode in dry hydrogen at temperatures of about 1500° C. to about 2200° C. for about 2 hours to about 16 hours to a desired density of about 72 percent to about 78 percent, (D) impregnating the cathode with copper filler material at about 1100° C. to about 1150° C., (E) cooling the cathode and then machining the face of the cathode surface to provide a spiral surface finish with microscopic sharp protrusions, (F) removing the bulk of the copper filler material by firing at about 1400° C., (G) acid etching to remove the remaining residual copper, (H) cleaning the cathode and then firing at about 1100° C., (I) impregnating the cathode with an active material in an inert atmosphere at about 1500° C. to about 1600° C., and (J) cleaning the cathode of any residue of impregnated material.

DESCRIPTION OF THE DRAWING

Referring to FIG. 1, the block diagram of the method steps represents a flow sheet of the invention. Referring to FIG. 2 and FIG. 3, the method of making a cathode, 10 includes machining the face of the cathode surface, 12 to provide a spiral surface finish, 14 with microscopic sharp symmetrical protrusions or spikes, 16.

DESCRIPTION OF THE PREFERRED EMBODIMENT

Figure 1A:
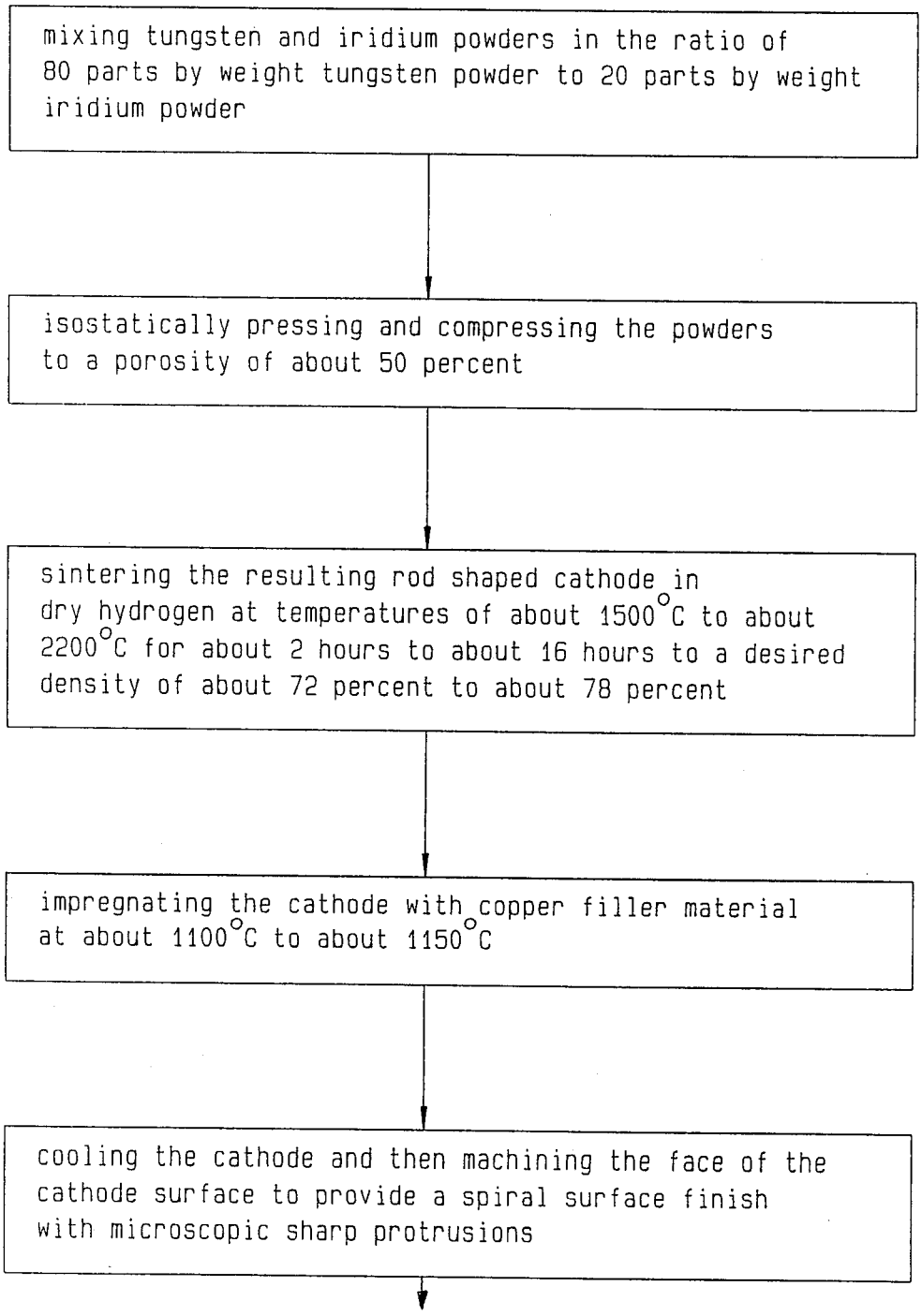
FIG. 1A and FIG. 1B comprise a block diagram of the method steps.
Figure 1B:
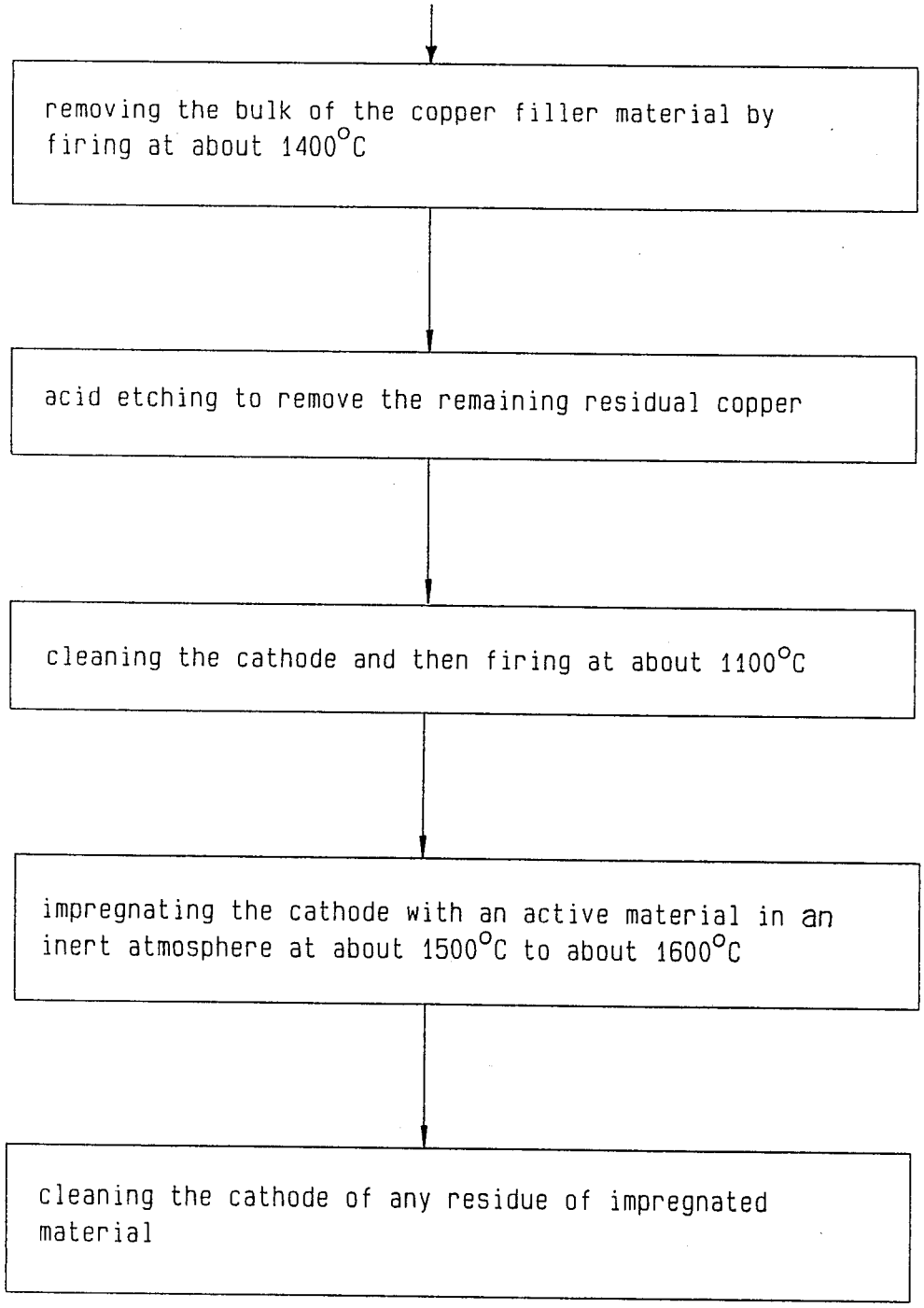
Figure 2:
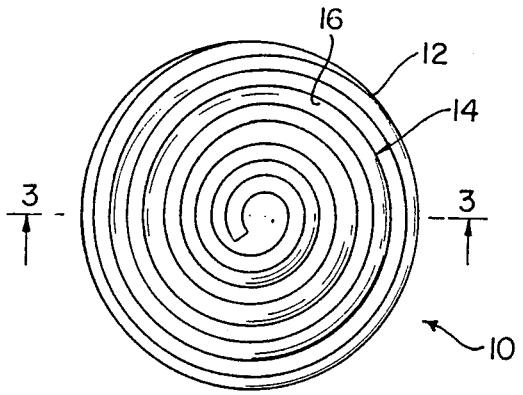
FIG. 2 is a top plan view of the face of the cathode surface.
Figure 3:
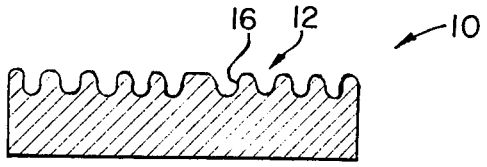
FIG. 3 is a section taken along line 3—3 of FIG. 2.

A thermionic field emitter cathode is prepared according to the method of the invention in the following manner.

Tungsten and iridium powders are mixed in the ratio of 80 parts by weight of tungsten powder to 20 parts by weight of iridium powder. The mixed powders are placed in a jig and isostatically pressed and compressed to a porosity of about 50 percent. After isostatic pressing, the rod shaped cathode is sintered in dry hydrogen at temperatures of 1500° C. to 2200° C. for 2 to 16 hours to achieve the desired density of about 72 to 78 percent. The cathode is then impregnated with a filler material such as copper at about 1100° C. to 1150° C. The cathode is then cooled, and the face of the cathode to surface, 12 is machined to a 32 to 63 surface turn finish to give a spiral surface finish, 14 with microscopic symmetrical sharp protrusions, 16. The sharp protrusions or spikes are approximately 1 micron in diameter at the tip and approximately 1 micron in height. The bulk of the cathode filler material is then removed by firing at about 1400° C. An acid etch is then used to remove the remaining residual copper. The cathode is then cleaned and fired at about 1100° C. Then, the cathode is impregnated in an inert atmosphere with an active material such as a barium strontium aluminate such as (6 BaO.1-SrO. $1Al_2O_3$) at about 1580° C. or a barium calcium aluminate such as (6 BaO.1CaO.$1Al_2O_3$) at about 1580° C. The cathode is then cleaned of any residue of impregnated material.

By making the cathode by the method of this invention, the effective cathode surface area is doubled.

In the method, in lieu of tungsten and iridium as the starting powders one can use other tungsten materials such as tungsten and osmium, tungsten alone, or tungsten and rhenium.

The cathode surface can be machined in conventional manner with a tungsten carbide tool bit or a diamond tool bit.

If desired, an activator such as about 1 percent by weight of zirconium hydride can be included with the starting powders.

Standard cleaning practices are used in the cleaning steps.

We wish it to be understood that we do not desire to be limited to the exact details as described for obvious modifications will occur to a person skilled in the art.

What is claimed is:

1. Method of making a thermionic cathode for use in millimeter wave/microwave high power electron tubes from tungsten and iridium powders, said method including the steps of:

(A) mixing the tungsten and iridium powders in the ratio of 80 parts by weight tungsten powder to 20 parts by weight iridium powder, (B) isostatically pressing and compressing the powders to a porosity of about 50 percent, (C) sintering the resulting cathode in dry hydrogen at temperatures of about 1500° C. to about 2200° C. for about 2 hours to about 16 hours to a desired density of about 72 to about 78 percent, (D) impregnating the cathode with copper filler material at about 1100° C. to about 1150° C., (E) cooling the cathode and then machining the face of the cathode surface to provide a spiral surface finish with microscopic sharp symmetrical protrusions, (F) removing the bulk of the copper filler material by firing at about 1400° C., (G) acid etching to remove the remaining residual copper, (H) cleaning the cathode and then firing at about 1100° C., (I) impregnating the cathode with an active material in an inert atmosphere at about 1500° C. to about 1600° C., and (J) cleaning the cathode of any residue of impregnated material.

2. Method according to claim 1 wherein about 1 percent by weight of zirconium hydride powder is included in the initial mixture as an activator.

3. Method according to claim 1 wherein the sharp surface protrusions are about 1 micron in diameter at the top and approximately 1 micron in height.

4. Method according to claim 1 wherein the active material is selected from the group consisting of a barium strontium aluminate and a barium calcium aluminate.

5. Method according to claim 4 wherein the active material is a barium strontium aluminate.

6. Method according to claim 4 wherein the active material is a barium calcium aluminate.

* * * * *